US010750922B2

(12) United States Patent
Williams et al.

(10) Patent No.: US 10,750,922 B2
(45) Date of Patent: Aug. 25, 2020

(54) REPLACEABLE SCRUBBING DEVICE ATTACHABLE TO A MOP HOLDER

(71) Applicants: Todd A Williams, Huntington Beach, CA (US); Cynthia K Williams, Huntington Beach, CA (US); Ryan Matthew Peterson, Oak Ridge, TN (US)

(72) Inventors: Todd A Williams, Huntington Beach, CA (US); Cynthia K Williams, Huntington Beach, CA (US); Ryan Matthew Peterson, Oak Ridge, TN (US)

( * ) Notice: Subject to any disclaimer, the term of this patent is extended or adjusted under 35 U.S.C. 154(b) by 539 days.

(21) Appl. No.: 15/478,025

(22) Filed: Apr. 3, 2017

(65) Prior Publication Data

US 2017/0280962 A1 Oct. 5, 2017

Related U.S. Application Data

(60) Provisional application No. 62/317,182, filed on Apr. 1, 2016.

(51) Int. Cl.

| | |
|---|---|
| ***A47L 13/12*** | (2006.01) |
| ***A47L 13/44*** | (2006.01) |
| ***A47L 13/24*** | (2006.01) |

(52) U.S. Cl.

CPC ..... *A47L 13/12* (2013.01); *A47L 13/24* (2013.01); *A47L 13/44* (2013.01)

(58) Field of Classification Search

CPC ..... A47L 13/12; A47L 13/24; A47L 13/44
See application file for complete search history.

(56) References Cited

U.S. PATENT DOCUMENTS

| | | | | |
|---|---|---|---|---|
| 798,172 | A | 8/1905 | Ducret | |
| 2,683,886 | A * | 7/1954 | Neumann | A47L 13/12 15/115 |
| 2,689,131 | A | 9/1954 | Priest | |
| 2,895,152 | A * | 7/1959 | Vosbikian | A47L 13/12 15/116.2 |
| 3,964,121 | A * | 6/1976 | Kim | A46B 15/00 15/115 |
| 4,491,998 | A * | 1/1985 | Wilson | A47L 13/144 15/118 |
| 4,642,836 | A * | 2/1987 | Bokmiller | A47K 11/10 15/118 |
| 4,642,837 | A | 2/1987 | Nichols et al. | |
| 5,172,447 | A | 12/1992 | Tomm | |
| D358,487 | S * | 5/1995 | Kneesch | D32/42 |
| 5,890,254 | A | 4/1999 | Courtney et al. | |
| 5,903,948 | A * | 5/1999 | Williams | A46B 5/00 15/115 |

(Continued)

FOREIGN PATENT DOCUMENTS

| | | |
|---|---|---|
| CA | 737140 | 6/1966 |
| DE | 29604237 | 5/1996 |
| GB | 2201627 | 9/1988 |

*Primary Examiner* — Marc Carlson
(74) *Attorney, Agent, or Firm* — Kirk A. Buhler; Buhler & Associates Patenting

(57) ABSTRACT

A scrubber or other attachment is removably coupled to a mop, preferably using a coupling on the mop holder, and preferably in a manner that does not interfere with the mop coupling and the handle coupling. The attachment can advantageously include a flexible joint.

16 Claims, 15 Drawing Sheets

(56) References Cited

U.S. PATENT DOCUMENTS

| | | | | |
|---|---|---|---|---|
| 5,964,005 | A * | 10/1999 | Williams | A47L 13/24 15/115 |
| 6,085,377 | A * | 7/2000 | Williams | A47L 13/24 15/115 |
| 6,105,193 | A * | 8/2000 | Williams | A47L 13/24 15/115 |
| 6,178,581 | B1 * | 1/2001 | Lewis | A47L 13/12 15/116.2 |
| 6,216,306 | B1 | 4/2001 | Esterson et al. | |
| 6,247,199 | B1 | 6/2001 | Petner | |
| 6,836,921 | B1 * | 1/2005 | Petner | A47L 13/24 15/115 |
| 7,124,464 | B2 * | 10/2006 | Williams | A47L 13/12 15/115 |
| 7,584,518 | B1 * | 9/2009 | Morad | A46B 7/04 15/116.2 |
| 7,624,469 | B2 * | 12/2009 | Specht | A47L 13/12 15/115 |
| 8,397,338 | B2 | 3/2013 | Dihn | |
| 8,561,245 | B2 * | 10/2013 | Weis | A47L 13/12 15/116.2 |
| 9,498,100 | B2 * | 11/2016 | Conway | A47L 13/255 |
| 2002/0029433 | A1 * | 3/2002 | Libman | A47L 13/12 15/119.2 |
| 2004/0098820 | A1 * | 5/2004 | Williams | A47L 13/12 15/115 |
| 2009/0113651 | A1 | 5/2009 | Giacolo et al. | |
| 2016/0207190 | A1 | 7/2016 | Balz et al. | |

* cited by examiner

REPLACEABLE SCRUBBING DEVICE ATTACHABLE TO A MOP HOLDER

This application claims priority to U.S. Provisional Application No. 62/331,804 filed May 4, 2016. All extrinsic material identified herein are incorporated by reference in their entirety.

FIELD OF THE INVENTION

The field of the invention is floor mops.

BACKGROUND

The background description includes information that may be useful in understanding the present invention. It is not an admission that any of the information provided herein is prior art or relevant to the presently claimed invention, or that any publication specifically or implicitly referenced is prior art.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Typical mop devices have a bundle of fabric rags or yarns attached to the end of a mop holder. During a cleaning operation, the operator dips the mop head into a cleaning fluid (e.g., water with dissolved detergent) to absorb some cleaning fluid, and then moves the mop back and forth or in a figure eight motion on a floor surface. This type of cleaning operation can efficiently wipe surfaces and remove loose debris and dirt. However, aggressive scrubbing is required to remove tough ground-in dirt, grease and hardened materials that build up in the grout lines of tiles, accumulate in the pores on the floor surface or adhere to the surface, and (i) the mop head fabric is too soft, and (ii) the contact area between the mop head and the floor surface is relatively large to effectively remove tough, ground-in dirt, grease and hardened materials.

In many applications, a rough and porous floor surface is preferred for certain purposes, such as slip and fall protection. The floor of a restaurant's kitchen is typically made of clay or porcelain tiles with rough porous surfaces to protect people from slipping. To maintain this kind of floor surface, the ground-in dirt, grease and contaminates stuck to or accumulated within the porous surface must be periodically removed by manual scrubbing using a scrub brush with sufficiently hard bristles or abrasive pads. Preferably, a scrub brush or abrasive pad is used on such a floor at least once per day. However, in actual practice, a scrub brush or abrasive pad is used far less frequently, resulting in unnecessarily slippery and contaminated floor surfaces.

Combination mop and scrubber devices have been disclosed. For example, a floor mop having a brush attachment is disclosed in Canadian Pat. No. 737,140. By tilting the handle against the mop holder at different angles, the brush can be placed in contact or out of contact with the floor surface. Although certain advantages have been achieved by this cleaning apparatus, it has several significant disadvantages.

First, the positions of the mop and the brush relative to the floor surface can only be adjusted by tilting the handle against the mop holder. For example, the brush is brought out of contact with the floor surface when the handle is in a vertical position (i.e., perpendicular to the mop holder surface), whereas the brush is moved forward to be in direct contact with the floor surface when the handle is in a substantially horizontal position (i.e., parallel to the mop holder surface). Consequently, the operator must use the cleaning apparatus at different angles between the handle and mopping surface, which can be difficult and uncomfortable. Secondly, the adjustable range of the brush is very limited.

In another example, U.S. Pat. No. 7,124,464 discloses a scrubbing device that is attachable to a mop device. The mop handle and mop holder of the mop device is unfastened to remove and replace the scrubbing device. Once fastened, the mop handle and mop holder act as a clamp to hold the scrubbing device against the mop head. Consequently, considerable effort is required to remove or replace the scrubbing device, and it must be removed and reinstalled every time a mop head is replaced or adjusted, which can be very frequent. Additionally, because of the frequent removal of the scrubbing device, it can easily become lost or broken from repeated clamping and unclamping to the mopping device or simply not be reinstalled.

Thus, there is still a need in the art for an improved mop holder and scrubber device that can be readily adjusted to meet the cleaning requirements of different floor surfaces and that provides a scrubbing attachment that is easily replaceable without a need to remove the mop head from the mop holder, and without requiring removal and reinstallment of the scrubber device every time a mop head is changed or adjusted.

SUMMARY OF THE INVENTION

The inventive subject matter provides apparatus, systems, and methods in which a mop attachment that is easily replaceable and readily adjusted for use with a mop device is provided. The mop device comprises a (1) a mop handle, (2) a mop holder having a first connector, and (3) a mop head. The mop holder is coupled to the mop handle at a handle coupling, and the mop holder is coupled to the mop head at a mop coupling. The mop attachment comprises a second connector that removably mates with the first connector, independently of the handle coupling and the mop coupling (i.e., without interfering or uncoupling with the handle coupling and the mop coupling). Thus, the need to remove (1) the mop handle from the mop holder or (2) the mop holder from the mop head to replace a mop attachment is eliminated. Further, the need to remove the mop attachment from the first connector to replace a mop head is eliminated.

Additionally, a scrubber plate is coupled to a second connector through one or more flexible joints. The scrubber plate is provided at favorable angles to allow a scrubber coupled to the scrubber plate to be readily used. It is contemplated that the flexible joint(s) comprises a material that allows the scrubber plate to bend at least 120 degrees or at least 90 degrees. A scrubber can be fixedly coupled (i.e., permanently attached) or removably coupled to the scrubber plate. When removably coupled, the scrubber can comprise projections that mate with a notch or an aperture of the scrubber plate. The scrubber plate can comprise a handle, so that the mop attachment can be used as a hand scrubbing tool. Additionally or alternatively, the scrubber can removably couple to a handle, for use as a hand scrubbing tool.

The second connector can have various structures that correspond to the first connector. In some embodiments, the second connector comprises a notch or an aperture that mates with a rib of the first connector. For example, the second connector can comprise a tab having the notch or aperture that mates with a rib on the first connector. Additionally, a second tab is contemplated that mates with a second rib on the first connector. In other embodiments, the second connector slidably mates with a channel of the first connector. For example, the second connector comprises a tab that slidably mates with a notch or an aperture on a side of the channel. As used herein, both a notch and an aperture are considered to be species of a slot.

In another aspect, a mop attachment for use with (1) a mop handle, (2) a mop holder, and (3) a mop head is contemplated. The mop holder is coupled to the mop handle at a handle coupling, and the mop holder is coupled to the mop head at a mop coupling. The attachment comprises a scrubber removably coupled to the mop holder through one or more flexible joints, independently of the handle coupling and mop coupling. The scrubber typically comprises a brush or an adhesive pad.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Also, as used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The inventor has produced a mop attachment that can be easily attached and removed from a connector on a mop device. The connector can be permanently affixed or removably coupled to at least one of a mop holder, a mop head, and a mop handle. The mop attachment can comprise a scrubbing pad, brush or other scrubbing material to increase the capabilities of an ordinary mop device. Specifically, the mop attachment allows the mop device to effectively clean various floors with rough and porous surfaces (e.g., clay, porcelain, glazed and concrete floor surfaces) that are susceptible to tough ground-in dirt, grease and hardened materials. It is contemplated that the mop attachment can be replaced without the need to remove (i) a mop head from the mop holder or (ii) the mop holder from the mop handle. Thus, a user can easily replace or change the mop attachment or mop head when cleaning a floor surface.

Additionally, contemplated mop attachments comprise one or more flexible joints that allow a user to obtain optimal scrubbing angles. Through the flexible joint(s), the scrubber and scrubber plate is allowed to bend relative to the mop holder and mop handle so that the scrubber is flat on the floor surface when cleaning a floor surface. It should be appreciated that having a scrubber oriented to be flat with the floor surface during cleaning increases the surface area of the floor surface that is being scrubbed. Additionally, since the mop attachment is easily interchangeable, the mop attachment can be replaced with other mop attachments having scrubbers of a different size and/or type to accommodate the different dimensions or the floor types of the floor surface (e.g., a corner, narrow passage or a wide walkway, high and low spots on cleaning surfaces, etc.).

Figure 1A:
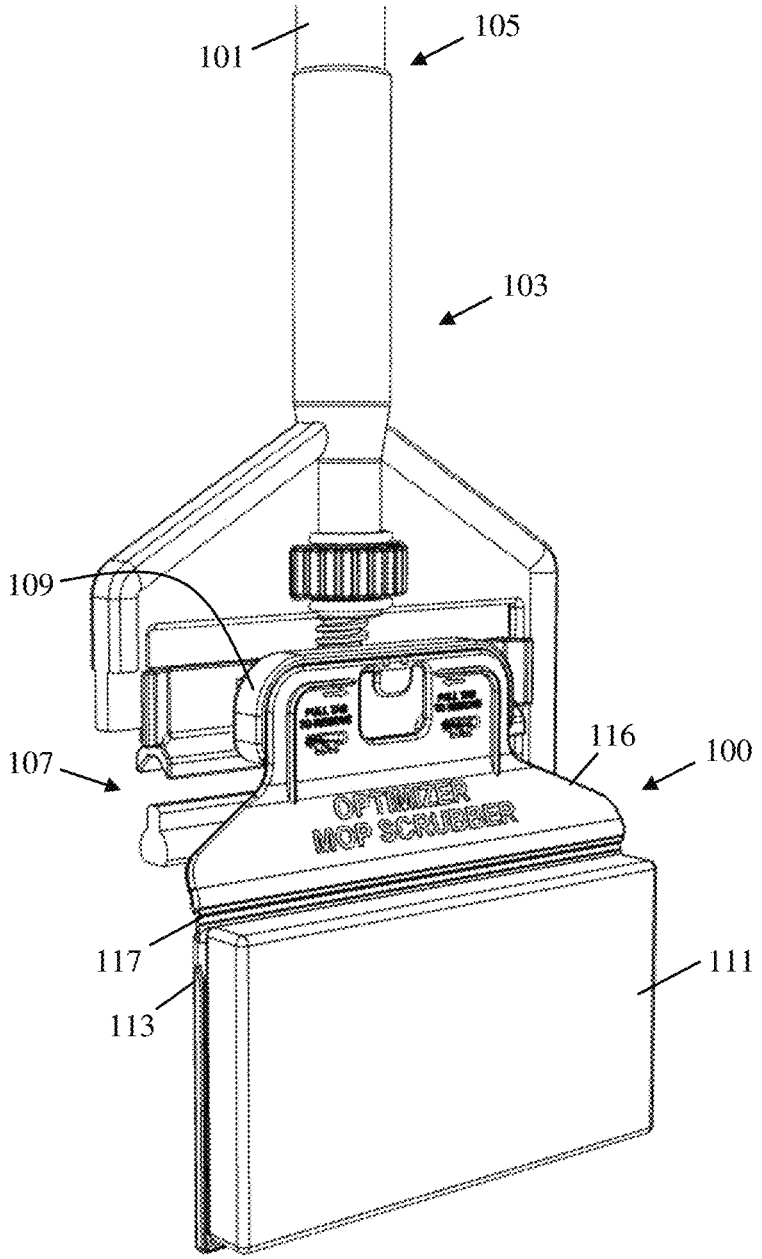
FIG. 1A is a front perspective view of an embodiment of a mop attachment attached to a mop holder.
Figure 1B:
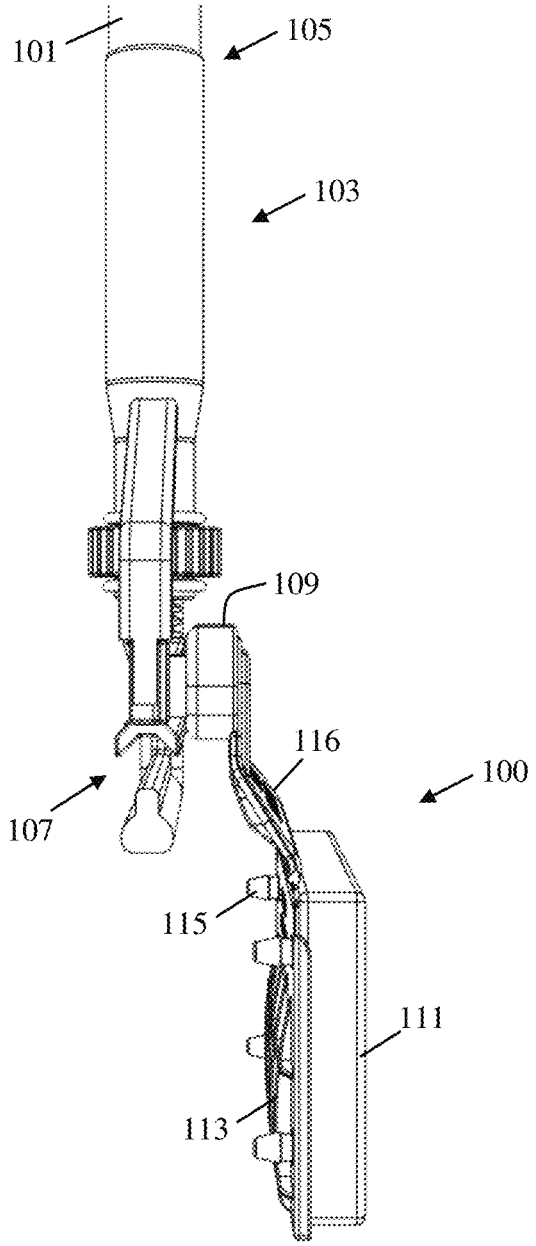
FIG. 1B is a side perspective view of the mop attachment and mop holder of FIG. 1.

FIGS. 1A-1B show a contemplated mop attachment 100 for use with a mop handle 101, a mop holder 103, and a mop head. The mop holder 103 is coupled to the mop handle 101 at a handle coupling 105, and the mop head is coupled to a mop holder 103 at a mop coupling 107. Typically, the mop head comprises a bundle of strings, yarn, cloth, or other absorbent material that may have a fabric or mesh headband or be attached to an integrated plastic molded headband (e.g., SYR type mop heads, ABCO type mop heads, etc.) that is attached to the mop holder 103 (e.g., mop head 1995 in FIG. 19). The mop head is clamped by two members of mop holder 103 at mop coupling 107 to hold the mop head while cleaning a floor surface.

Mop attachment 100 is removably coupled with a first connector 109 disposed on mop holder 103. While first connector 109 is shown on mop holder 103, it is contemplated that first connector 109 can be disposed on mop handle 101 and/or the mop head. In other words, it is contemplated that first connector 109 can be permanently affixed or removably coupled to at least one of a mop holder, a mop handle, and a mop head of any kind. It should be appreciated that first connector 109 has a position that does not interfere with mop coupling 107 or handle coupling 105. In other words, there is no need to remove mop handle 101 from mop holder 103 or the mop head from mop holder 103 in order to couple or uncouple mop attachment 100 to first connector 109.

First connector 109 can be permanently affixed to mop holder 103. However, in other embodiments, first connector 109 can be removably coupled with mop holder 103. In such embodiments, first connector 109 can be removably coupled with the mop head and/or mop handle 101 to provide alternative connection points for mop attachment 100. Additionally, or alternatively, multiple first connectors 109 can be permanently affixed or removably coupled with at least one of mop holder 103, mop handle 101, and the mop head.

Mop attachment 100 comprises a scrubber 111 coupled with a scrubber plate 113. Although scrubber 111 is shown as a scrubber pad (e.g., an abrasive pad), it is contemplated that scrubber 111 can also comprise a brush or other scrubbing material. In some embodiments, scrubber 111 is permanently affixed to scrubber plate 113. However, in other embodiments, scrubber 111 is removably coupled to scrubber plate 113. For example, scrubber 111 can comprise projections 115 that removably mate with apertures of scrubber plate 113 as shown in FIG. 1B. In another example, scrubber 111 and scrubber plate 113 can comprise Velcro™ that removably mates the scrubber 111 and scrubber plate 113. It is contemplated that scrubber 111 and scrubber plate 113 can be directly coupled (i.e., coupled without use of an intermediate component) or indirectly coupled (e.g., coupled via use of a scrubber holder 847 in FIG. 8).

Typically, scrubber 111 extends from a first surface of mop attachment 100, and the opposing, second surface faces the mop head (i.e., the surface where projections 115 extend). When the second surface is positioned to face the floor surface, then scrubber 111 will face the opposite direction and the mop head can be used to clean the floor surface. When flipped, the first surface is positioned to face the floor surface, such that scrubber 111 can be used to clean the floor surface.

Mop attachment 100 comprises a flexible joint 117 that is coupled to scrubber plate 113. Flexible joint 117 allows scrubber 111 and scrubber plate 113 to bend relative to mop holder 103 and mop handle 101. Although one flexible joint 117 is shown in FIG. 1A, it is contemplated that mop attachment 100 can comprise multiple flexible joints. A sloped surface 116 is angled with respect to scrubber plate 113 to thereby shift scrubber plate 113 away from the mop head to minimize interference of scrubber plate 113 with the mop head and/or the mop bucket wringer.

Figure 2A:
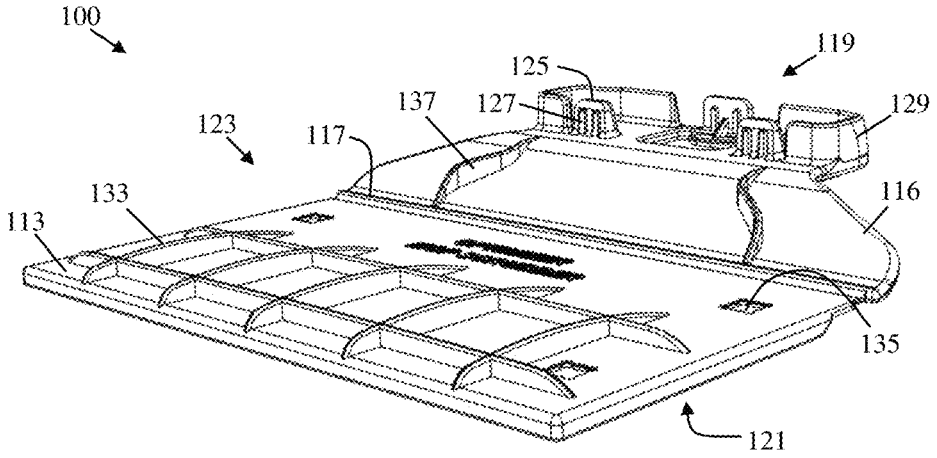
FIG. 2A is a top perspective view of the mop attachment of FIG. 1.
Figure 2B:
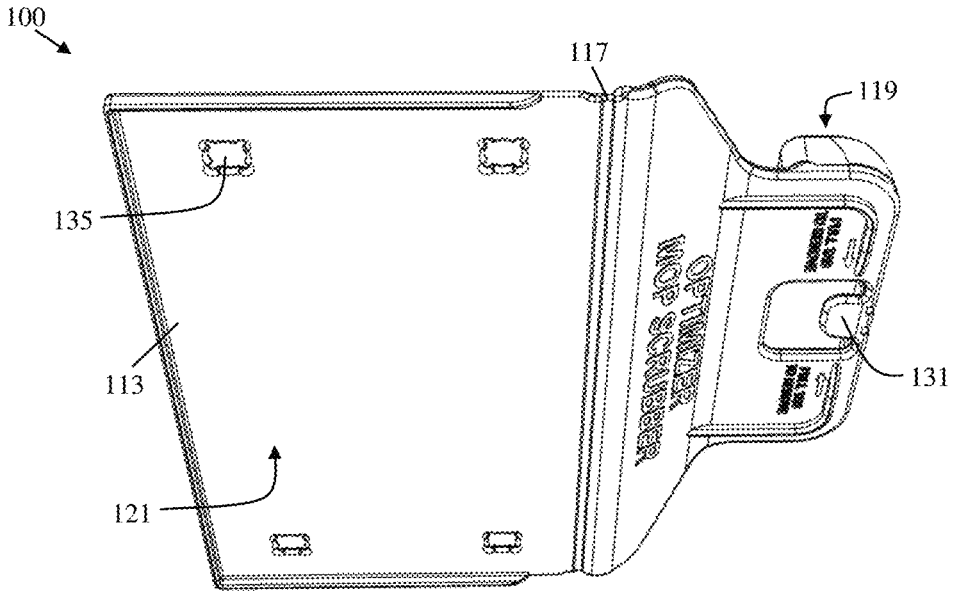
FIG. 2B is a bottom perspective view of the mop attachment of FIG. 2A.
Figure 2C:
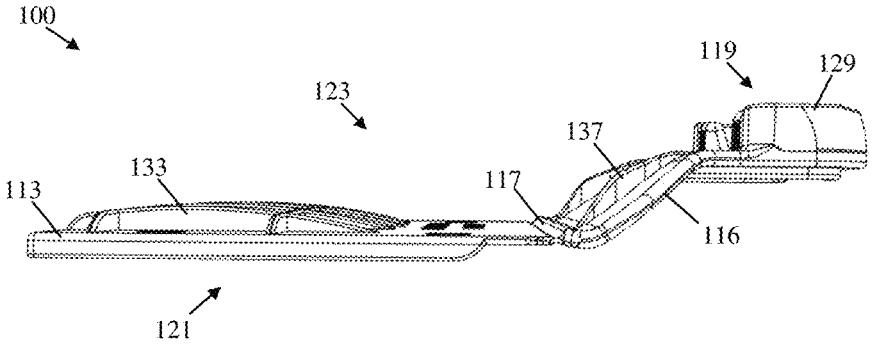
FIG. 2C is a side perspective view of the mop attachment of FIG. 2A.

FIGS. 2A-2C show additional details of mop attachment 100. Mop attachment comprises a second connector 119 that removably mates with first connector 109, independently of handle coupling 105 and mop coupling 107. Mop attachment 100 comprises a scrubber side 121 and an opposite top side 123. It is contemplated that second connector 119 extends from top side 123 as shown in FIG. 2A.

Second connector 119 comprises a tab 125 that mates with a rib on first connector 109. As shown in FIG. 2A, tab 125 comprises an aperture 127 that is sized and dimensioned to receive the rib of first connector 109. It is contemplated that tab 125 can comprise multiple apertures 127 that mate with respective ribs on first connector 109. Additionally, or alternatively, tab 125 can comprise a notch (i.e., a closed-ended cavity or pocket) that is sized and dimensioned to receive a rib of first connector 109. It should be appreciated that more than one tab 125 can be disposed in second connector 119 as shown in FIG. 2A. A wall 129 that extends from top side 123 can be disposed proximal to tab 125 within second connector 119. It is contemplated that tab 125 and wall 129 are sized and dimensioned to be received by a recess of first connector 109 to couple mop attachment 100 to first connector 109. A pull-tab 131 disposed near second connector 119 can be used by a user to decouple mop attachment 100 from first connector 109.

Top side 123 of mop attachment 100 can further comprise strengthening ribs 133 to provide extra strength to scrubber plate 113. Scrubber plate 113 can further comprise apertures 135 that mate with projections of a scrubber 111. Thus, scrubber 111 can be removably coupled with scrubber plate 113. However, in other embodiments, scrubber 111 can be permanently affixed to scrubber plate 113.

Scrubber plate 113 can be coupled with second connector 119 through flexible joint 117. In some embodiments, sloped surface 116 is disposed between second connector 119 and flexible joint 117. It is contemplated that flexible joint 117 comprises a material that allows scrubber plate 113 to bend at least one of 60, 90, 120 and 150 degrees. Similar to scrubber plate 113, it is contemplated that sloped surface 116 comprises strengthening ribs 137.

Figure 3A:
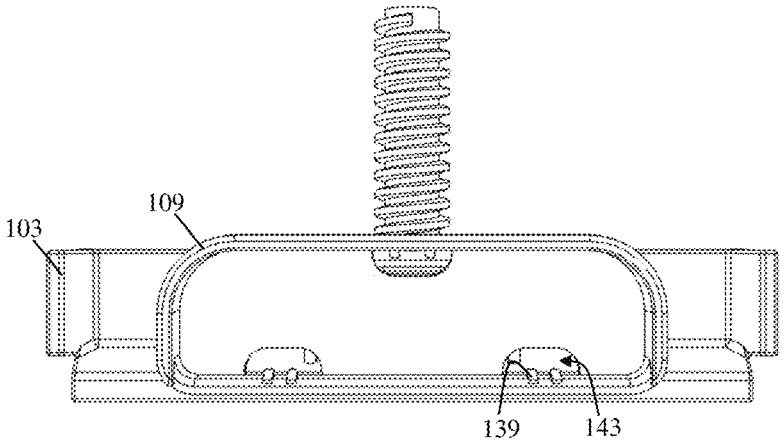
FIG. 3A is a front perspective view of the first connector of the mop holder of FIG. 1.
Figure 3B:
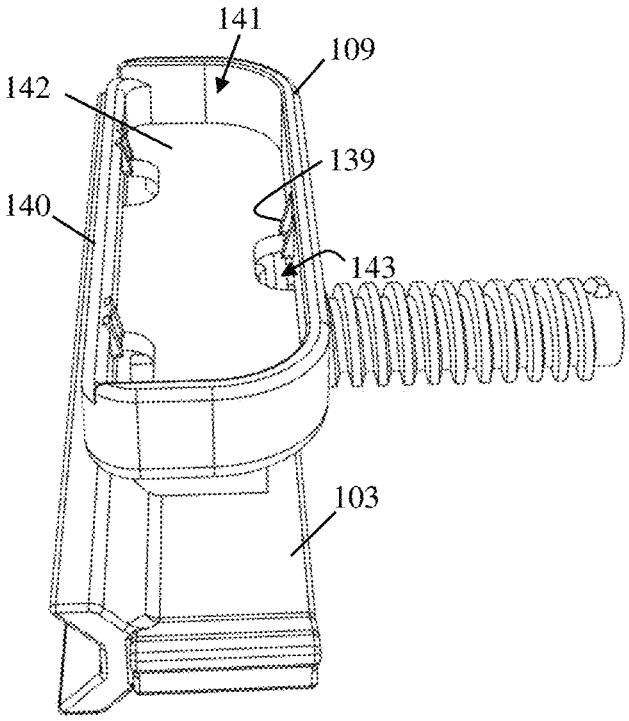
FIG. 3B is a top perspective view of the first connector of FIG. 3A.

FIGS. 3A-3B show additional details of first connector 109. As described above, first connector 109 is disposed on mop holder 103. In this embodiment, first connector 109 is disposed on a first member of mop holder 103 that clamps the mop head with a second member of the mop holder 103. Other locations for first connector 109 are contemplated as described above.

First connector 109 comprises a rib 139 that extends from an interior surface of a rim 140 first connector 109. As shown in FIG. 3A, it is contemplated that first connector 109 comprises more than one rib 139 to mate with respective apertures 127 or notches of second connector 119. In other words, first connector 109 comprises a first component of a mating catch (e.g., rib 139, slot, projection, etc.) that mates with a second component of a mating catch (e.g., aperture 127 or notch, rib, projection, etc.) of second connector 119. It is contemplated that first connector 109 defines a recess 141 that is sized and dimensioned to receive second connector 119. As second connector 119 is inserted into recess 141, it is contemplated tab 125 slides against rib 139 until rib 139 is received by aperture 127 or a notch to couple first connector 109 and second connector 119. It is contemplated that other connections can be used to couple first connector 109 and second connector 119 (e.g., friction fit, threaded connection, other male-female connections, etc.).

First connector 109 further comprises an aperture 143 that is sized and dimensioned to receive at least a portion of tab 125 when first connector 109 and second connector 119 are coupled. In some embodiments, rib 139 can gradually widen as shown in FIG. 3B. The gradual change in width allows second connector 119 to be inserted with greater ease while maintaining a firm connection once first connector 109 and second connector 119 are coupled.

Rim 140 is preferably tall enough to significantly assist in retaining the second connector 119 within recess 141. In preferred embodiments at least a portion of rim 140 extends at least 0.5 cm from a floor 142 of the recess 141, (i.e., has rim 140 has a height of at least 0.5 cm) or from the side of the mop holder in cases where there rim 140 extends directly from the side of the mop holder. In more preferred embodiments at least a portion of the rim 140 has a height of at least 0.75 cm, and in most preferred embodiments, at least a portion of the rim 140 has a height of at least 1 cm.

Figure 4:
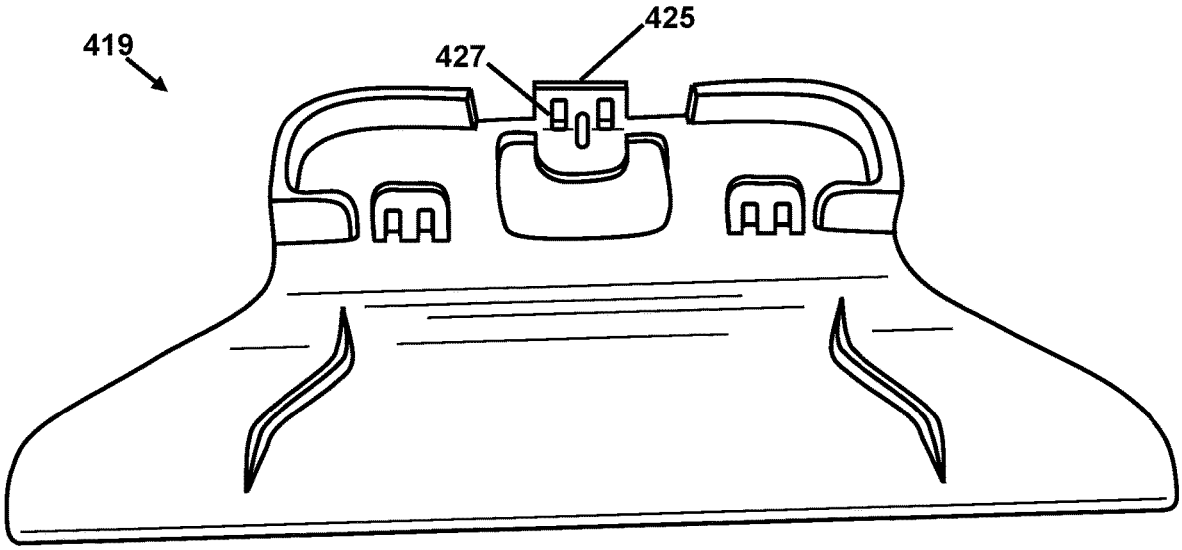
FIG. 4 is top perspective view of an embodiment of a second connector of a mop attachment.

First connector 109 can have multiple sets of ribs 139 and apertures 143 to accommodate multiple tabs 125 of second connector 119. For example, FIG. 2A shows three tabs 125 that are used to couple with three sets of ribs 139 shown in FIG. 3A. It is contemplated that the sets of ribs 139 on first connector 109 can match the number of apertures 127 or notches on tabs 125. However, the sets of ribs 139 on first connector 109 can also be different than the number of tabs 125 or apertures 127 on second connector 119. For example, FIG. 4 shows a mop attachment having a second connector 419 having one tab 425. Tab 425 comprises an aperture 427 that is sized and dimensioned to receive rib 139 to thereby couple first connector 109 and second connector 419. It is contemplated that the other features of the mop attachment of FIG. 4 are the same as those of mop attachment 100.

Figure 5:
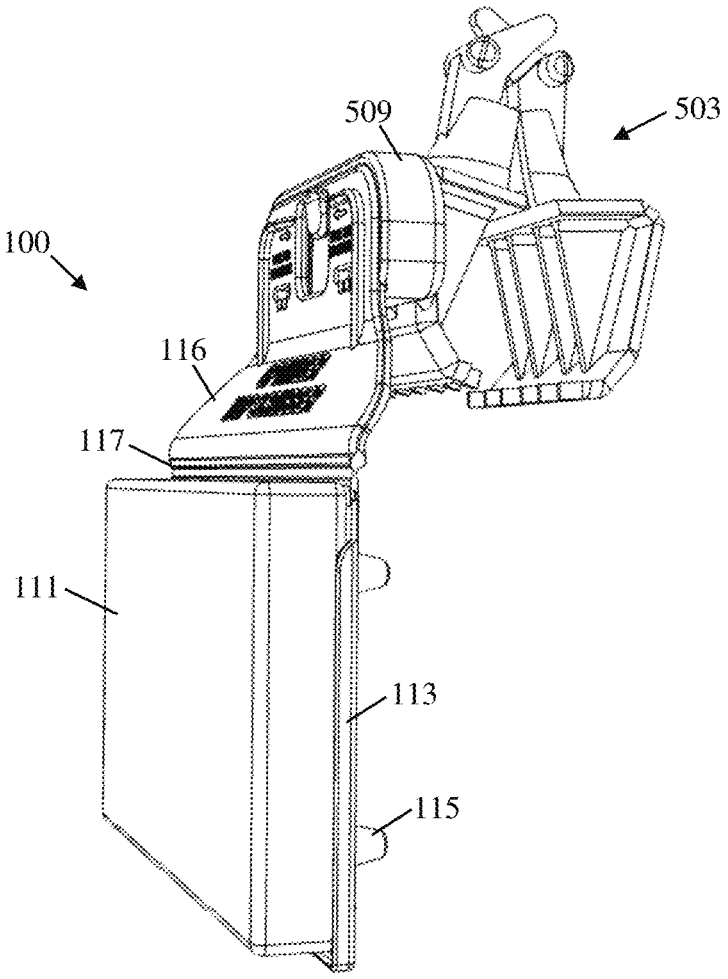
FIG. 5 is a side perspective view of an embodiment of a mop attachment attached to a mop holder.

FIG. 5 shows mop attachment 100 coupled to a mop holder 503. In contrast with mop holder 103, mop holder 503 is a jaw style mop holder. Mop holder 503 receives a mop head between its jaws at a mop coupling, and mop holder 503 is typically coupled to a mop handle at a handle coupling. Similar to that discussed above, mop attachment 100 is removably coupled to a first connector 509, independent of both the mop coupling and the handle coupling. In other words, there is no need to remove (i) the mop head from mop holder 503 or (ii) mop holder 503 from the mop handle in order to replace mop attachment 100. Nor is there a need to remove the mop attachment 100 from the mop holder 503 in order to replace the mop head. As discussed above, mop attachment can comprise sloped surface 116, flexible joint 117, scrubber 111 with projections 115, and scrubber plate 113.

Figure 6A:
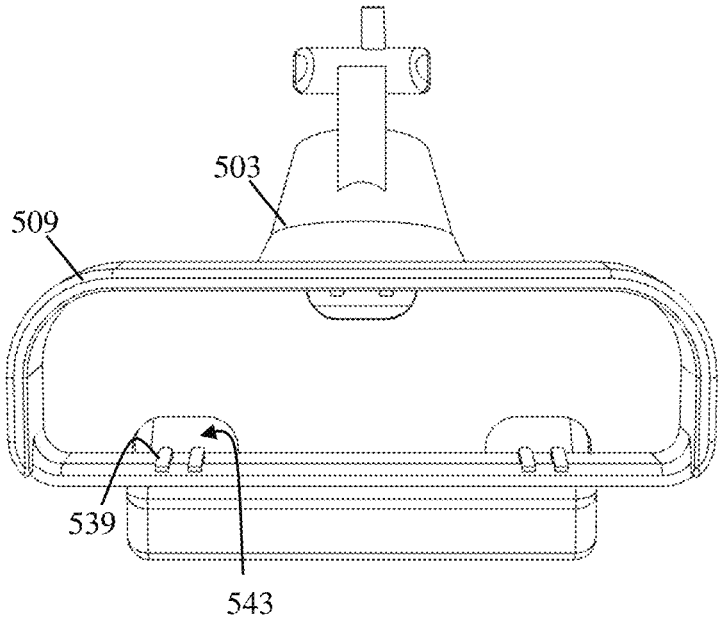
FIG. 6A is a front perspective view of a first connector of the mop holder of FIG. 5.
Figure 6B:
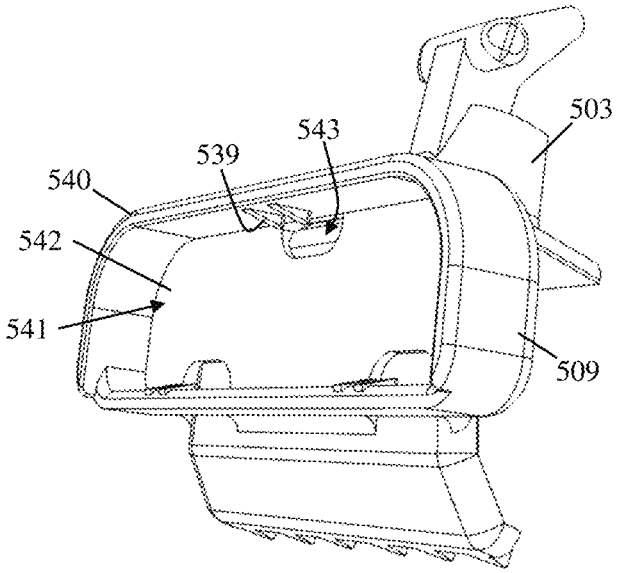
FIG. 6B is a side perspective view of the first connector of FIG. 6A.

First connector 509 comprises a rib 539 that extends from an interior surface of rim 540 as shown in FIGS. 6A-6B. Rib 539 is configured to removably mate with an aperture 127 or notch of second connector 119. In other words, first connector 509 comprises a first component of a mating catch (e.g., rib 539, slot, projection, etc.) that mates with a second component of a mating catch (e.g., aperture 527 or notch, rib, projection, etc.) of second connector 119. Typically, second connector 119 is inserted into a recess 541 of first connector 509, such that tab 125 slides against rib 539 until rib 539 is received by aperture 127 or a notch to couple first connector 509 and second connector 119. Similar to that described above, first connector 509 can comprise an aperture 543 sized and dimensioned to receive at least a portion of tab 125 when first connector 509 and second connector 119 are coupled.

Rim 540 is preferably tall enough to significantly assist in retaining the second connector 119 within recess 541. In preferred embodiments at least a portion of rim 540 extends at least 0.5 cm from a floor 542 of the recess 541, (i.e., has rim 540 has a height of at least 0.5 cm) or from the side of the mop holder in cases where there rim 540 extends directly from the side of the mop holder. In more preferred embodiments at least a portion of the rim 540 has a height of at least 0.75 cm, and in most preferred embodiments, at least a portion of the rim 540 has a height of at least 1 cm.

As used herein, a statement that the "rim extends outwardly from a side of the mop holder" is to be interpreted broadly to indicate direction. Thus, the term is to be interpreted as including situations where the rim is continuous with the side of the mop holder, where the rim is glued or clipped onto the side of the mop holder, or the rim directly or indirectly extends in any other manner in an outward direction from the side of the mop holder.

Figure 7:
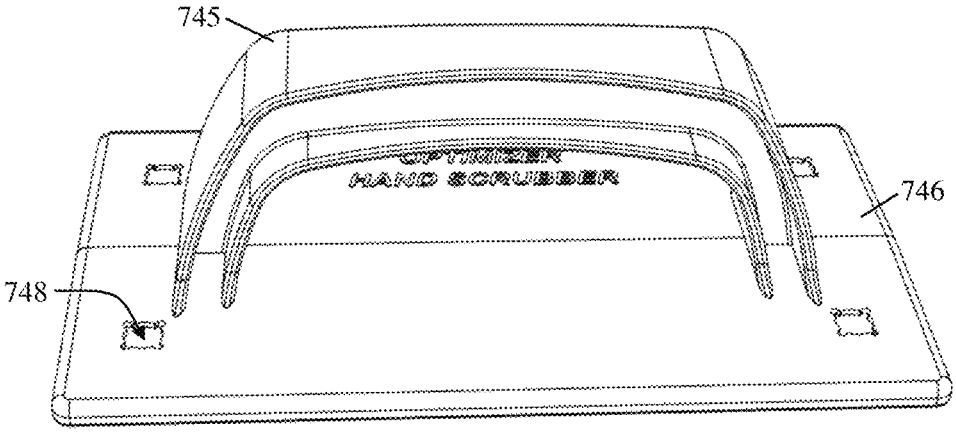
FIG. 7 is a top perspective view of an embodiment of a handle that can hold a scrubber of a mop attachment.

FIG. 7 shows a handle 745 disposed on a handle plate 746. It is contemplated that handle plate 746 can removably couple with a scrubber. For example, handle plate 746 can comprise an aperture 748 that is sized and dimensioned to receive projection 115 of scrubber 111. Handle 745 can be used to mount or remove scrubber 111 from scrubber plate 113 for use as a hand scrubber. Additionally, or alternatively, it should be appreciated that a handle (e.g., a handle having the same structure as handle 745) can be incorporated in the mop attachment devices described herein (e.g., mop attachment 100, etc.) to thereby provide function as a hand scrubber. For example, it is contemplated that the handle can extend from a top side of a scrubber plate and a scrubber can extend from an opposite, scrubber side of the scrubber plate. Thus, the overall utility of the mop attachment and mop are increased by provided a handle for use with the mop attachment as a hand scrubber.

Figure 8:
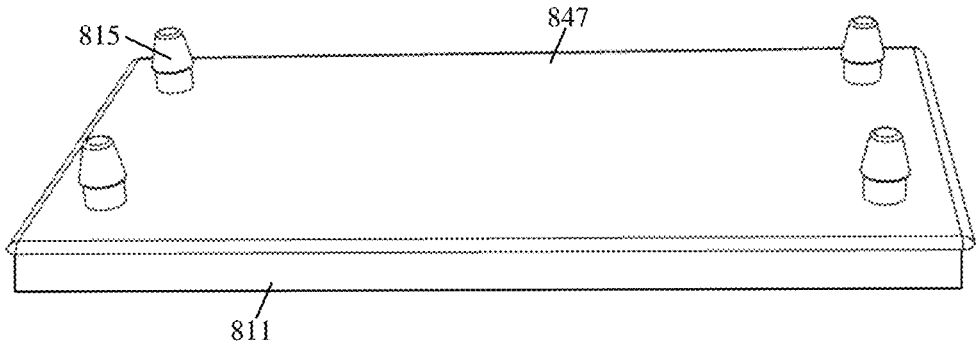
FIG. 8 is a top perspective view of an embodiment of a scrubber of a mop attachment.

As discussed above, it is contemplated that the scrubber is removably coupled with the scrubber plate. For example, FIG. 8 shows a scrubber 811 that is affixed to a scrubber holder 847. Scrubber holder 847 comprises projections 815 that removably mate with apertures of a scrubber plate (e.g., apertures 735 of scrubber plate 713, apertures 135 of scrubber plate 113). Although scrubber 811 is shown as a scrubber pad, it is contemplated that scrubber 811 can be a brush or other scrubbing material sufficient to remove tough ground-in dirt, grease and hardened materials. It is contemplated that scrubber 811 can be permanently affixed (e.g., glued, fused, staple set or otherwise permanently attached) or removably coupled to scrubber holder 847.

It is contemplated that a mop attachment can removably attach to at least one of a mop handle, a mop head, and a mop handle using various forms. As shown above, second connector 119 of mop attachment 100 or second connector 419 of another mop attachment can couple first connector 109 of mop holder 103 or first connector 509 of mop holder 503. Typically, second connector 119 or 419 is inserted into first connector 109 or 509 to couple the mop attachment to the mop holder. However, in other embodiments, it is contemplated that a second connector can slidably mate with a first connector.

Figure 9:
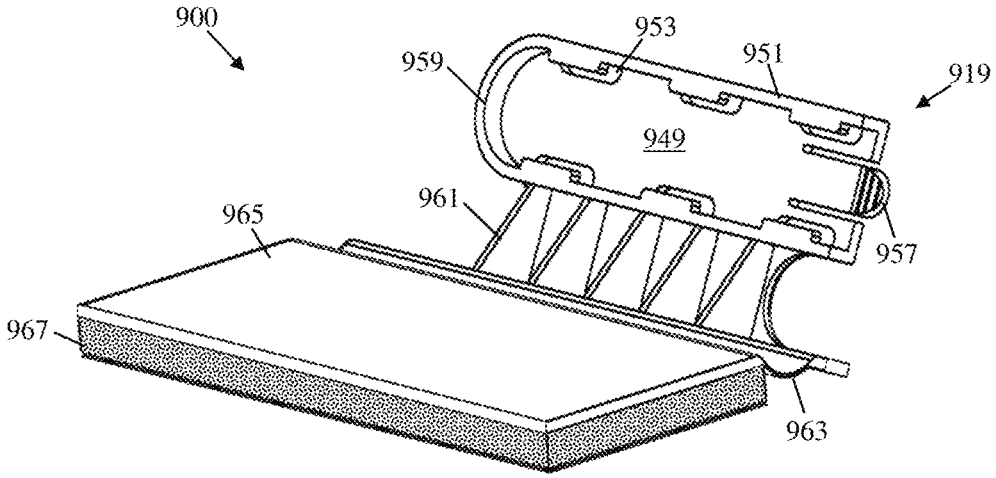
FIG. 9 is a perspective view of an embodiment of a mop attachment.
Figure 13:
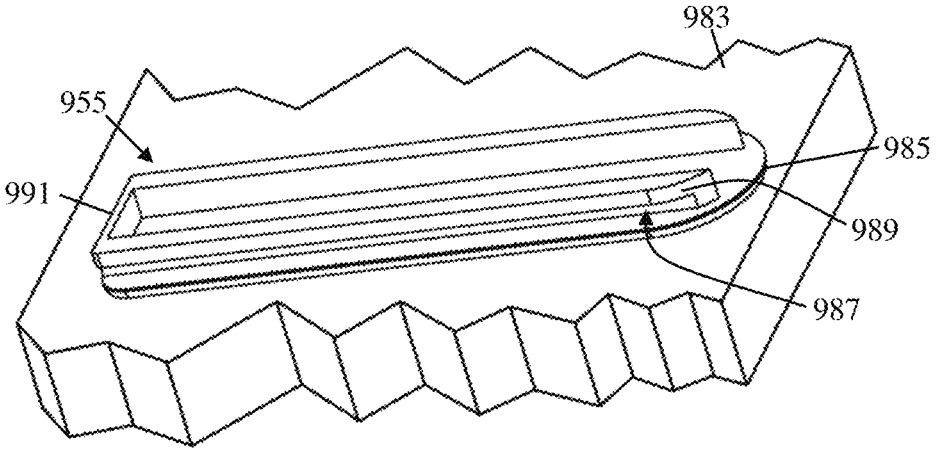
FIG. 13 is a front perspective view of an embodiment of a first connector.

FIG. 9 is a perspective view of a mop attachment 900. Mop attachment 900 has a second connector 919 having a pocket area 949 with a surrounding ridge 951 and a number of tabs 953. It is contemplated that mop attachment 900 slides onto a first connector on at least one of a mop head, a mop holder, and a mop handle. For example, mop attachment 900 can be slid onto a first connector 955 as shown in FIG. 13. Mop attachment 900 is slid first through the area near an entry tab 957, which comprises a flexible material. An end stop 959 prevents over-insertion and retains the end of the mop attachment 900 on first connector 955.

Second connector 919 is coupled with supporting ribs 961. A flexible joint 963 is disposed between second connector 919 and a scrubber 967, which could be a brush or pad. Scrubber 967 is typically attached to a scrubber plate 965. Scrubber plate 965 is allowed to bend or flex on the flexible joint 963. Although one flexible joint 963 is shown in FIG. 9, it is contemplated that mop attachment 900 can comprise multiple flexible joints.

Figure 10:
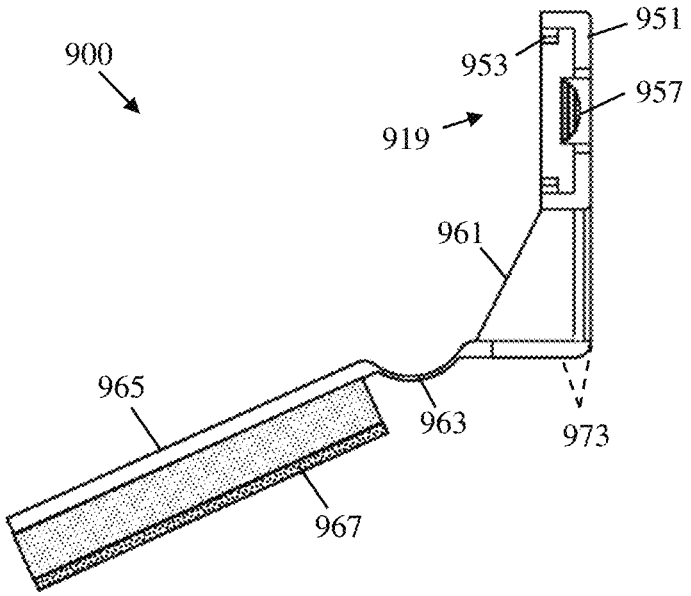
FIG. 10 is a side perspective view of the mop attachment of FIG. 9.
Figure 11:
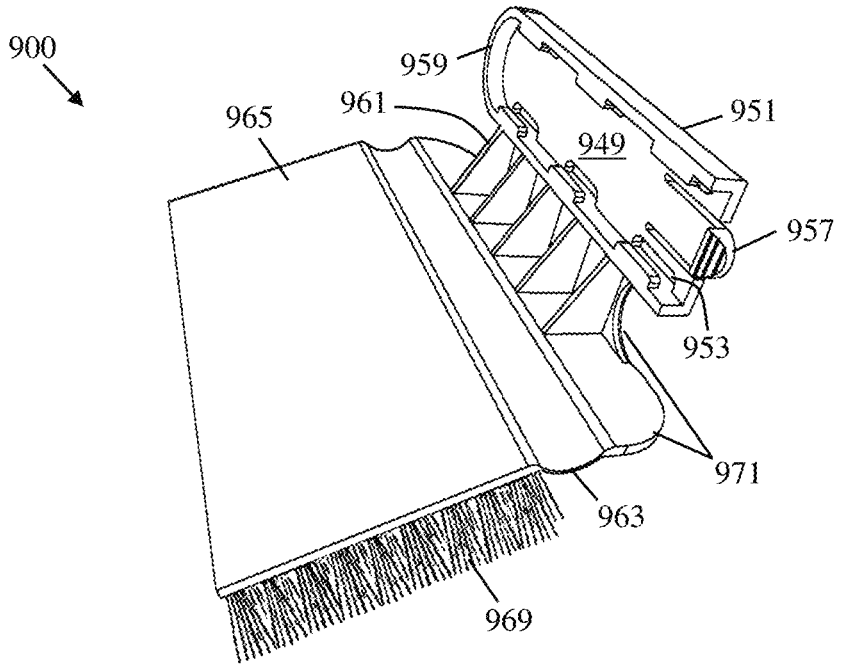
FIG. 11 is a top perspective view of an embodiment of a mop attachment.

FIG. 10 is a side view of mop attachment 900 having scrubber 967, and FIG. 11 is a perspective view of 900 mop attachment having bristles 969. As discussed above, second connector 919 has a mounting plate having pocket area 949 with surrounding ridge 951 and tabs 953. Second connector 919 slides onto the first connector 955 as shown in FIG. 13. It is contemplated that tab 957 and the area around it is flexible to allow second connector 919 to initially slide onto first connector 955. In order to prevent over-insertion, end stop 959 interferes with a surface of first connector to prevent further sliding and rests on an end of first connector 955. Mop attachment 900 further comprises walls 971 that provide structural strength and concentrate bending to flexible joint 963. It is contemplated that an integrated scraper 973 can be incorporated to aid in the removal of stuck items such as gum.

Figure 12:
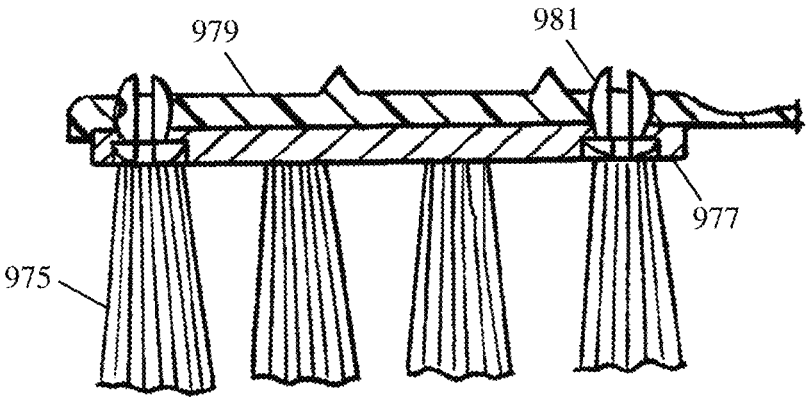
FIG. 12 is a side perspective view of an embodiment of a scrubber and scrubber plate.

As discussed above, it is contemplated that a scrubber or brush is removably coupled to a scrubber plate of a mop attachment. FIG. 12 is a side view of an embodiment where the scrubbing materials 975, either abrasive pads or bristles are glued, fused, staple set or otherwise attached to a plate 977 (e.g., scrubber holder), which is then removably attached to a scrubber plate 979. Scrubber plate 979 comprises apertures that receive projections 981 that extend from plate 977.

FIG. 13 is a perspective view of first connector 955. It is contemplated that first connector can be disposed on at least one of a mop handle, mop holder, and mop head. First connector 955 extends from a surface 983 of a mop handle, mop holder, mop head, or other similar equipment. First connector 955 comprises a surrounding plateau 985 that engages at least a portion of surrounding ridge of second connector 919. First connector 955 has a channel 987 that guides and receives tabs 953 of second connector 919. It is contemplated that first connector 955 has a second channel that also receives tabs 953 in order to accommodate tabs 953 on opposing surfaces of surrounding ridge 951 of second connector 919. Typically, first connector 955 is received by pocket area 949 when first connector 955 and second connector 919 are coupled. A retaining lip 989 maintains tabs 953 of second connector 919 within channel 987 of first connector 955. An end rib 991 prevents debris from entering under and into the securing/sliding portion by acting as a barrier against debris that would otherwise enter pocket area 949 when first connector 955 and second connector 919 are coupled.

Figure 14:
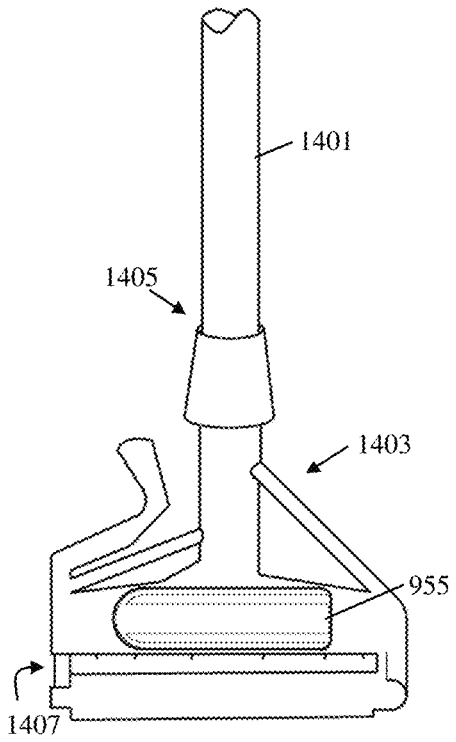
FIG. 14 is a front perspective view of another embodiment of a mop holder with a first connector.

FIG. 14 shows a first type of mop holder 1403 having first connector 955. As shown, first connector 955 is disposed on mop holder 1403 in a manner that does not interfere with a handle coupling 1405 (i.e., coupling between a mop handle 1401 and mop holder 1403) or mop coupling 1407 (i.e., coupling between mop holder 1403 and a mop head). The mop head is clamped by mop holder 1403 at mop coupling 1407. First connector 955 can be permanently affixed or removably coupled with mop holder 1403.

Figure 15:
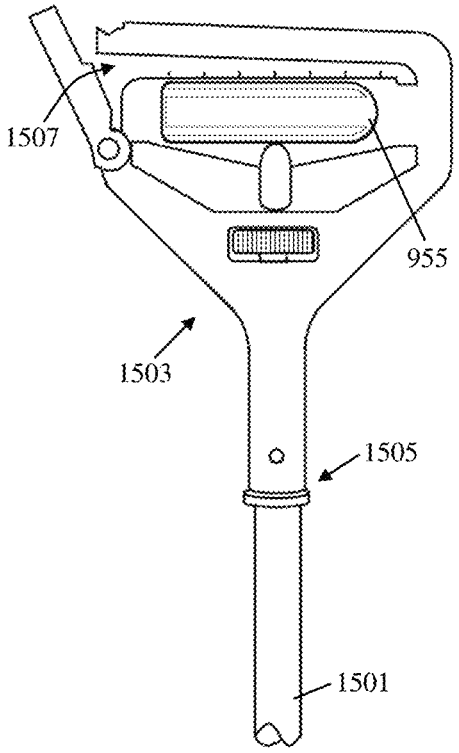
FIG. 15 is a front perspective view of another embodiment of a mop holder with a first connector.
Figure 16:
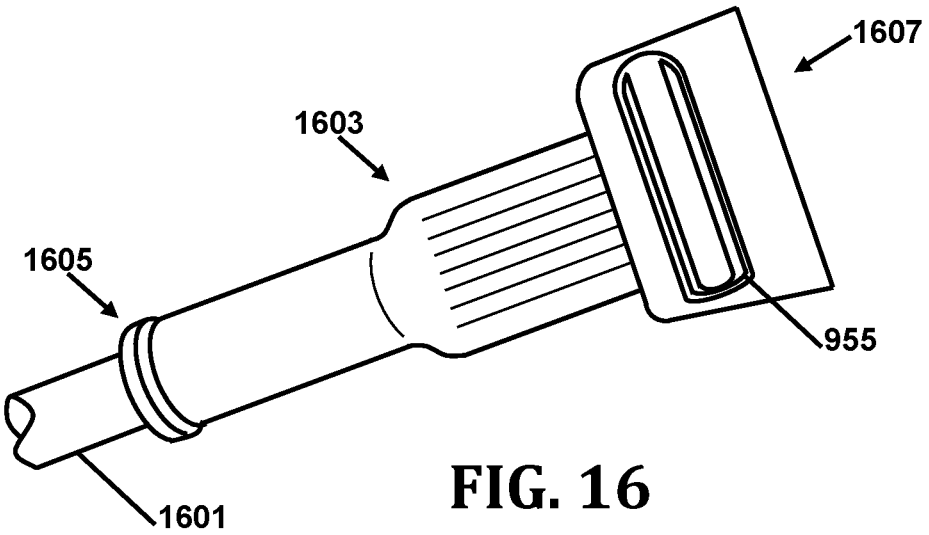
FIG. 16 is a front perspective view of another embodiment of a mop holder with a first connector.

FIG. 15 shows a second type mop holder 1507 having first connector 955. As shown, first connector 955 is disposed on mop holder 1503 in a manner that does not interfere with a handle coupling 1505 (i.e., coupling between a mop handle 1501 and mop holder 1503) or mop coupling 1507 (i.e., coupling between mop holder 1503 and a mop head). FIG. 16 shows a third type mop holder 1603 having first connector 955. Again, first connector 955 is disposed on mop holder 1603 in a manner that does not interfere with a handle coupling 1605 (i.e., coupling between a mop handle 1601 and mop holder 1603) or mop coupling 1607 (i.e., coupling between mop holder 1603 and a mop head).

Figure 17:
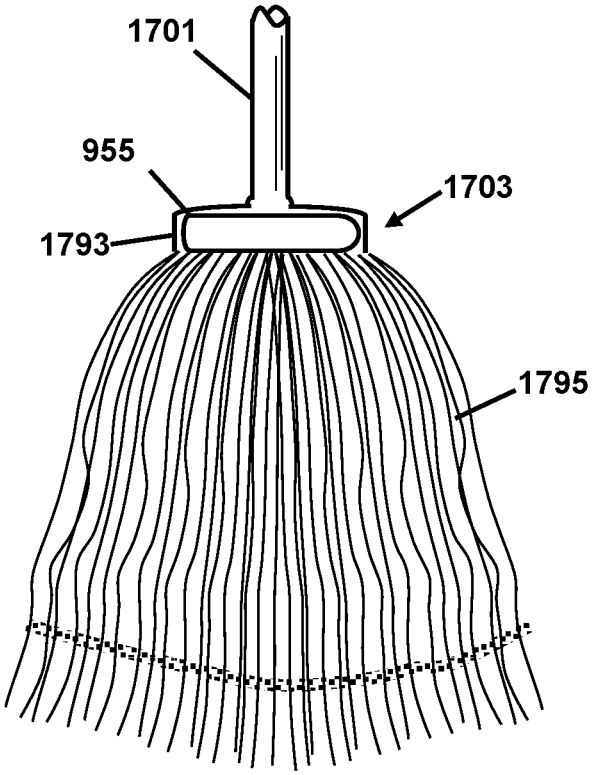
FIG. 17 is a front perspective view of another embodiment of a mop holder with a first connector.

FIG. 17 shows a fourth type of mop holder 1703 with first connector 955. Mop holder 1703 comprises an integrated plastic molded headband 1793. It is contemplated that first connector 955 can be permanently affixed or removably coupled to headband 1793. Headband 1793 is coupled to a mop head 1795. Similar to other embodiments, first connector 955 does not interfere with the coupling between (i) a mop handle 1701 and mop holder 1703 or (ii) mop holder 1703 and mop head 1795.

Although first connector 955 is shown in the different types of mop holders in FIGS. 14-17, it is contemplated that such mop holders can comprise first connector 109 and/or first connector 509. In such embodiments, first connector 109 and/or first connector 509 can be permanently affixed or removably coupled to the mop holders or mop headbands. It is contemplated that first connector 109, first connector 509 or first connector 955 could be molded into the mop holders or mop headbands.

Figure 18:
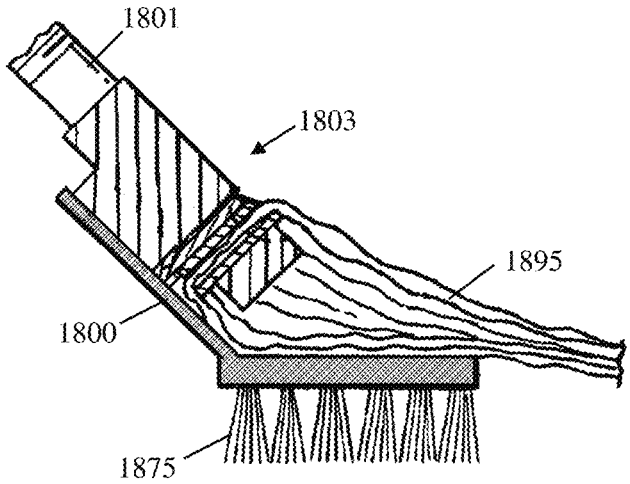
FIG. 18 is a side perspective view of an embodiment of a mop attachment in a first orientation.
Figure 19:
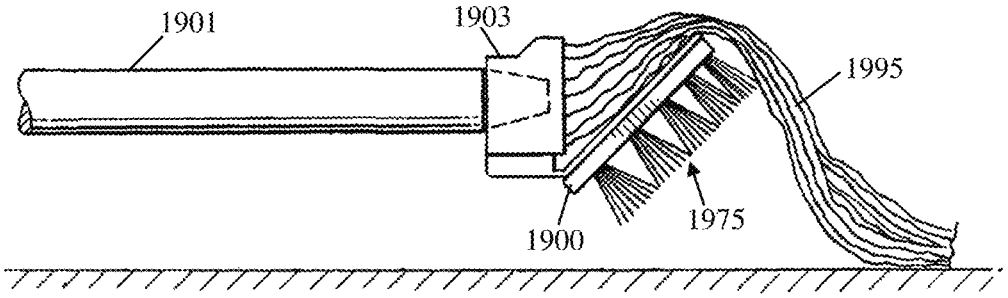
FIG. 19 is a side perspective view of an embodiment of a mop attachment in a second orientation.

FIGS. 18 and 19 show a mop attachment in a first and second orientation, respectively. In FIG. 18, mop handle 1801 is in a tilted position for floor scrubbing by a brush 1875 of a mop attachment 1800. Typically, a portion of mop attachment 1800 extends at the same angle as mop handle 1801 relative to a floor surface. A mop holder 1803 holds a mop head 1895. It should be appreciated that mop handle 1801 can be used to rotate mop holder 1803 and mop attachment 1800 so that mop head 1895 is disposed below mop attachment 1800 to mop a floor surface. FIG. 19 shows a mop handle 1901 horizontal to a floor surface allowing a user to clean underneath equipment or other obstructions. At this angle, a brush 1975 of a mop attachment 1900 is oriented away from the floor surface. Similar to the embodiment above, a mop holder 1903 holds a mop head 1995.

While several male and female connections between a mop holder and a mop attachment are shown and described, it is contemplated that the first connector can be placed, permanently or removably, anywhere on a mop handle, a mop holder, or a mop head. Preferably, the first connector is disposed on a mop holder at a position near a mop headband or mop head, such that the mop attachment lies under the mop head when a floor is being scrubbed.

It is contemplated that a first connector (e.g., first connector 109, first connector 509, first connector 955, etc.) can be integrated in the molding of the handle or glued, riveted, fused or otherwise permanently or removably attached to the mop handle. It is also contemplated that a first connector can be integrated into the plastic molded headband or glued, riveted, fused or otherwise permanently or removably attached to the plastic molded headband.

Thus, specific embodiments of a replaceable scrubbing element attachable to a mop handle have been disclosed. It should be apparent, however, to those skilled in the art that many more modifications besides those described are possible without departing from the inventive concepts herein. The inventive subject matter, therefore, is not to be restricted except in the spirit of the appended claims.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements. Moreover, and unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure all terms should be interpreted in the broadest possible manner consistent with the context. In particular the terms "comprises" and "comprising" should be interpreted as referring to the elements, components, or steps in a non-exclusive manner, indicating that the referenced elements, components, or steps can be present, or utilized, or combined with other elements, components, or steps that are not expressly referenced.

What is claimed is:

1. A mop attachment, for use with a mop handle, a mop holder, a first connector, a mop head, wherein the mop holder is coupled to the mop handle at a handle coupling, and the mop holder is coupled to the mop head at a mop coupling, the attachment comprising:

wherein the first connector is configured to accept removable attachments;

a second connector that is configured to removably mate with the first connector, independently of the mop handle coupling and the mop coupling;

a scrubber plate coupled to a scrubber; the scrubber plate further coupled to the second connector through a flexible joint; and said flexible joint is configured to allow the scrubber plate and the scrubber to flex at least 90 degrees relative to the second connector and mop handle to allow the scrubber to be oriented flat on a floor surface when scrubbing the floor surface.

2. The attachment of claim 1, wherein the second connector comprises a notch or an aperture that is configured to mate with a rib of the first connector.

3. The attachment of claim 1, wherein the scrubber plate comprises a scrubber side and an opposite top side, and wherein the second connector extends from the top side.

4. The attachment of claim 3, wherein the second connector comprises a tab that is configured to mate with a rib on the first connector.

5. The attachment of claim 4, wherein the tab comprises a notch or an aperture that is configured to mate with the rib on the first connector.

6. The attachment of claim 4, further comprising a wall that extends from the top side, and wherein the tab and the wall are sized and dimensioned to be received by a recess of the first connector.

7. The mop holder of claim 6, wherein at least a portion of the recess of the first connector has a depth of at least 0.5 cm.

8. The attachment of claim 3, wherein the scrubber is coupled to the scrubber side of the scrubber plate.

9. The attachment of claim 3, further comprising a second tab that is configured to mate with a second rib on the first connector.

10. The attachment of claim 1, wherein the second connector that is configured to slidably mate with a channel of the first connector.

11. The attachment of claim 10, wherein the second connector comprises a tab that is configured to mate with a notch or an aperture on a side of the channel.

12. The attachment of claim 1, wherein the flexible joint is configured to allow the scrubber plate and the scrubber to flex at least 120 degrees relative to the second connector and mop handle.

13. The attachment of claim 1, wherein the scrubber is fixedly coupled to the scrubber plate.

14. The attachment of claim 1, wherein the scrubber is removably coupled to the scrubber plate.

15. The attachment of claim 14, wherein the scrubber comprises a projection that is configured to mate with a notch or an aperture of the scrubber plate.

16. The attachment of claim 1, wherein the scrubber plate comprises a handle that extends from a top side of the scrubber plate.

* * * * *